US008673532B2

(12) United States Patent
Casalmir et al.

(10) Patent No.: US 8,673,532 B2
(45) Date of Patent: Mar. 18, 2014

(54) METHOD OF PRODUCING DRY TONER PARTICLES HAVING HIGH CIRCULARITY

(75) Inventors: Paul Casalmir, Sodus, NY (US); Bryan L. Norcott, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/533,346

(22) Filed: Jun. 26, 2012

(65) Prior Publication Data

US 2013/0344433 A1 Dec. 26, 2013

(51) Int. Cl.
*G03G 9/08* (2006.01)
*G03G 15/08* (2006.01)

(52) U.S. Cl.
USPC ..... 430/137.1; 430/110.3; 430/123.51; 430/137.18

(58) Field of Classification Search
USPC ..... 430/137.1, 137.18, 110.3, 123.51
See application file for complete search history.

(56) References Cited

U.S. PATENT DOCUMENTS

| | | | | |
|---|---|---|---|---|
| 3,590,000 | A | 6/1971 | Palermiti et al. | |
| 3,944,493 | A | 3/1976 | Jadwin et al. | |
| 4,007,293 | A | 2/1977 | Mincer et al. | |
| 4,054,465 | A | 10/1977 | Ziobrowski | |
| 4,079,014 | A | 3/1978 | Burness et al. | |
| 4,298,672 | A | 11/1981 | Lu | |
| 4,338,380 | A | 7/1982 | Erickson et al. | |
| 4,394,430 | A | 7/1983 | Jadwin et al. | |
| 4,433,040 | A | 2/1984 | Niimura et al. | |
| 4,560,635 | A | 12/1985 | Hoffend et al. | |
| 4,845,003 | A | 7/1989 | Kiriu et al. | |
| 4,894,308 | A | 1/1990 | Mahabadi et al. | |
| 4,937,157 | A | 6/1990 | Haack et al. | |
| 4,937,439 | A | 6/1990 | Wanninger et al. | |
| 5,370,962 | A | 12/1994 | Anderson et al. | |
| 5,624,079 | A | 4/1997 | Higuchi et al. | |
| 5,716,751 | A | 2/1998 | Bertrand et al. | |
| 5,763,132 | A | 6/1998 | Ott et al. | |
| 5,874,034 | A | 2/1999 | Proper et al. | |
| 5,959,066 | A | 9/1999 | Charbonneau et al. | |
| 5,998,079 | A | 12/1999 | Thompson et al. | |
| 6,025,061 | A | 2/2000 | Khanarian et al. | |
| 6,063,464 | A | 5/2000 | Charbonneau et al. | |
| 6,063,827 | A | 5/2000 | Sacripante et al. | |
| 6,107,447 | A | 8/2000 | Kreuder et al. | |
| 6,214,507 | B1 | 4/2001 | Sokol et al. | |
| 6,359,105 | B1 | 3/2002 | Ianni et al. | |
| 6,586,150 | B2 * | 7/2003 | Proper | 430/137.1 |
| 6,593,049 | B1 | 7/2003 | Veregin et al. | |
| 6,599,673 | B2 | 7/2003 | Kumar et al. | |
| 6,756,176 | B2 | 6/2004 | Stegamat et al. | |
| 6,830,860 | B2 | 12/2004 | Sacripante et al. | |
| 6,991,886 | B2 * | 1/2006 | Earley et al. | 430/137.1 |
| 7,097,349 | B2 | 8/2006 | Casalmir et al. | |
| 7,235,339 | B2 | 6/2007 | Casalmir et al. | |
| 7,452,646 | B2 | 11/2008 | Hu et al. | |
| 2005/0271969 | A1 * | 12/2005 | Choi et al. | 430/137.1 |
| 2007/0015075 | A1 | 1/2007 | Vijayendran et al. | |
| 2008/0090166 | A1 | 4/2008 | Jones et al. | |
| 2008/0090167 | A1 | 4/2008 | Bejat et al. | |
| 2008/0145775 | A1 | 6/2008 | Vijayendran et al. | |
| 2010/0159378 | A1 | 6/2010 | Srinivasan et al. | |
| 2011/0027714 | A1 * | 2/2011 | McDougall et al. | 430/108.11 |
| 2011/0223525 | A1 | 9/2011 | Sacripante et al. | |
| 2011/0250535 | A1 | 10/2011 | Vanbesien et al. | |
| 2012/0015292 | A1 | 1/2012 | Andaya et al. | |
| 2012/0043504 | A1 | 2/2012 | Yang et al. | |

* cited by examiner

*Primary Examiner* — Thorl Chea
(74) *Attorney, Agent, or Firm* — Oliff PLC

(57) ABSTRACT

A method for producing dry toner particles that have similar particle size and shape characteristics as chemically produced toners. The method includes melt-mixing a toner resin with a colorant and, optionally, a wax, to form a toner; grinding the toner to form toner particles; classifying the toner particles into particles averaging 4 to 10 microns in size; blending the classified toner particles with additives in a high-speed blender; and then processing the mixture with optional additional surface additives in a conical mixer. The method produces toner particles that have high circularity and sharper particle size distribution. The surface processing of the toner particles does not affect the internal constituents of the toner particles.

20 Claims, 2 Drawing Sheets

METHOD OF PRODUCING DRY TONER PARTICLES HAVING HIGH CIRCULARITY

BACKGROUND

Numerous process are known for the preparation of toners, such as, for example, emulsion/aggregation or a conventional process wherein a resin is melt kneaded or extruded with a pigment, micronized and pulverized to provide toner particles.

Rounded toner particles are generally produced via chemical aggregation and coalescence of the toner's various components in aqueous forms. The chemical aggregation process requires all raw materials to be dispersed in water using a surfactant and high-intensity homogenization equipment. Alternatively, chemically produced toners may be produced by solvent-based processes. The chemically produced polyester toners offer the advantage of increased xerographic transfer efficiency due to higher circularity and sharper particle size distribution. However, the chemical aggregation process is water-intensive and time-consuming. Therefore, the chemically made polyester toners are often not competitive against dry toners made by conventional methods.

In a conventional process for producing dry toner particles, the materials are fed in dry form into an extruder and melt-mixed in a continuous, controlled fashion to produce the desired toner characteristics. The materials do not have to be dispersed in water before the extrusion step. Instead, the material from the extruder is physically ground and classified to reach the desired particle size and size distribution. However, an issue that may arise with dry toners produced by the process including extrusion and physical grinding is that the resulting toner particles may be irregularly shaped, rather than spherical. Defects, including toner filming and unstable image quality, can occur where non-spherical toners are used.

SUMMARY

There remains a need for a method of producing significantly rounded dry toner particles that have similar characteristics to toner particles produced via chemical aggregation, by using conventional toner technology.

In view of the above, a method for creating dry toner particles that have similar particle size and shape characteristics as chemically produced toners, as well as a durable coating of surface additives is desired. In embodiments, the method may comprise producing dry toner particles comprising a toner resin, a colorant, an optional wax, and surface additives according to the conventional toner process, and then further processing the toner particles using a conical mixer.

In embodiments, the method may include melt-mixing at least one toner resin with at least one colorant and, optionally, a wax, to form a toner; grinding the toner to form toner particles; classifying the toner particles according to size; blending the classified toner particles with surface additives in a high-speed blender; and then processing the toner particles with optional additional surface additives in a conical mixer. Alternatively, the surface additives may be added only during the surface processing in a conical mixer, thus making it possible to eliminate the blending step. The method produces toner particles that have an increased circularity and a narrower (i.e., sharper) particle size distribution than the toner particles prior to processing. The surface processing of the toner particles does not affect the internal constituents of the toner particles.

By using existing infrastructure for a substantial portion of the method, and taking advantage of separating the process of creating the internal material matrix from the process of creating the particle size and shape distribution, embodiments of the method provide a cost advantage.

EMBODIMENTS

Figure 1:
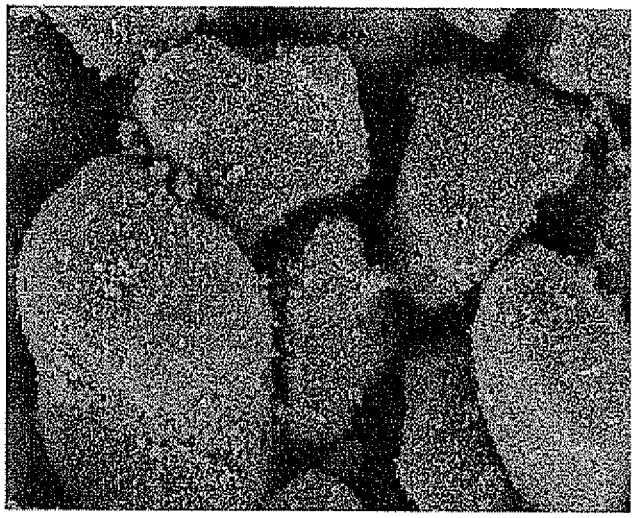
FIG. 1 is a Scanning Electro-Micrograph (SEM) image of toner particles according to an embodiment before surface processing.

A method for producing dry toner particles that have similar particle size and shape characteristics as chemically produced toners, as well as a durable surface additive layer, may comprise producing dry toner particles according to the conventional toner process, and then further processing the toner particles using a conical mixer that heats and stirs the material.

In embodiments, the method may include melt-mixing at least one toner resin with at least one colorant and, optionally, a wax, to form a toner; grinding the toner to form toner particles; classifying the toner particles according to size; blending the classified toner particles with surface additives in a high-speed blender; and then processing the toner particles with optional additional surface additives in a conical mixer. Alternatively, the surface additives may be added only during the surface processing in a conical mixer, thus making it possible to eliminate the blending step. The method produces toner particles that have an increased circularity and a narrower (i.e., sharper) particle size distribution than the toner particles prior to processing. The surface processing of the toner particles does not affect the internal constituents of the toner particles.

The method may also be advantageous for formulations that use constituents that may not always easily incorporate into a chemical process, such as magnetite or charge-control agents. In a different embodiment, the method may be extended to bio-based polyester resin systems. In yet different embodiments, the method may be extended to chemically produced toners to further increase the circularity of the chemically produced toner particles.

Resins

Any suitable resin may be utilized in forming a toner of the present disclosure. Such resins, in turn, may be made of any suitable monomer. Any monomer employed may be selected depending upon the particular polymer to be utilized.

Suitable monomers useful in forming the resin include, but are not limited to, styrenes, acrylates, methacrylates, butadienes, isoprenes, acrylic acids, methacrylic acids, acrylonitriles, diols, diacids, diamines, diesters, diisocyanates, combinations thereof, and the like. Any monomer employed may be selected depending upon the particular polymer to be utilized.

In embodiments, the resin may be a polymer resin including, for example, resins based on styrene acrylates, styrene butadienes, styrene methacrylates, and more specifically, poly(styrene-alkyl acrylate), poly(styrene-1,3-diene), polystyrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), polystyrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In other embodiments, the resins utilized to form toners of the present disclosure may be polyester resins. Such polyester resins may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, an unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof.

In embodiments, the organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof.

In embodiments the amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In some embodiments, the amorphous resin may be crosslinked. An example is described in U.S. Pat. No. 6,359,105, the disclosure of which is hereby incorporated by reference in its entirety. For example, crosslinking may be achieved by combining an amorphous resin with a crosslinker, sometimes referred to herein, in embodiments, as an initiator. Examples of suitable crosslinkers include, but are not limited to, for example, free radical or thermal initiators such as organic peroxides and azo compounds.

In embodiments, an amorphous resin utilized to form a toner of the present disclosure may be at least one bio-based amorphous polyester resin, optionally in combination with another amorphous resin as noted above. As used herein, a bio-based resin is a resin or resin formulation derived from a biological source such as vegetable oil instead of petrochemicals. As renewable polymers with low environmental impact, their principal advantages are that they reduce reliance on finite resources of petrochemicals; they sequester carbon from the atmosphere. A bio-based resin includes, in embodiments, for example, a resin wherein at least a portion of the resin is derived from a natural biological material, such as animal, plant, combinations thereof, and the like. In embodiments, at least a portion of the resin may be derived from materials such as natural triglyceride vegetable oils (e.g. rapeseed oil, soybean oil, sunflower oil) or phenolic plant oils such as cashew nut shell liquid (CNSL), combinations thereof, and the like. Suitable bio-based amorphous resins include polyesters, polyamides, polyimides, polyisobutyrates, and polyolefins, combinations thereof, and the like. In some embodiments, the bio-based resins are also biodegradable.

Examples of amorphous bio-based polymeric resins which may be utilized include polyesters derived from monomers including a fatty dimer acid, fatty dimer diacid or fatty dimer diol of soya oil, D-isosorbide, and/or amino acids such as L-tyrosine and glutamic acid as described in U.S. Pat. Nos. 5,959,066, 6,025,061, 6,063,464, and 6,107,447, and U.S. Patent Application Publications Nos. 2008/0145775 and 2007/0015075, the disclosures of each of which are hereby incorporated by reference in their entirety. Combinations of any of the foregoing may be utilized. Suitable amorphous bio-based resins include those commercially available from Advanced Image Resources (AIR), under the trade name 1310REZ 13062 and BIOREZ 15062. In embodiments, a suitable amorphous bio-based polymeric resin which may be utilized may include a dimer acid of soya oil, isosorbide (which may be obtained from corn starch), with the remainder of the amorphous bio-based polymeric resin being dimethyl terephthalate (DMT). Another suitable bio-based polymeric resin may include about 43.8% by weight D-isosorbide, about 42.7% by weight 1,4-cyclohexane dicarboxylic acid, and about 13.4% by weight of a dimer acid of soya oil.

In embodiments, a suitable amorphous bio-based resin may have a glass transition temperature of from about 45° C. to about 70° C., in embodiments from about 50° C. to about 65° C., a weight average molecular weight (Mw) of from about 2,000 to about 200,000, in embodiments of from about 5,000 to about 100,000, a number average molecular weight (Mn) as measured by gel permeation chromatography (GPC) of from about 1,000 to about 10,000, in embodiments from about 2,000 to about 8,000, a molecular weight distribution (Mw/Mn) of from about 2 to about 20, in embodiments from about 3 to about 15, and a viscosity at about 130° C. of from about 10 PaS to about 100,000 PaS, in embodiments from about 50 PaS to about 10,000 PaS.

The bio-based polymeric resin may have an acid value of from about 7 mg KOH/g to about 50 mg KOH/g, in embodiments from about 9 mg KOH/g to about 48 mg KOH/g, in embodiments about 9.4 mg KOH/g.

Where utilized, the amorphous bio-based resin may be present, for example, in amounts of from about 1 to about 95 percent by weight of the components used to form the toner particles, in embodiments from about 5 to about 50 percent by weight of the components used to form the toner particles.

In embodiments, the amorphous bio-based polyester resin may have a particle size of from about 50 nm to about 250 nm in diameter, in embodiments from about 75 nm to 225 nm in diameter.

In embodiments, suitable latex resin particles may include one or more amorphous bio-based resins, such as a BIOREZ resin described above, optionally in combination with one or more of the amorphous resins described above, optionally in combination with a crystalline resin as described below.

As noted above, the amorphous resin may be combined with a crystalline resin. The crystalline resin may be, for example, a polyester, a polyimide, a polyimide, a polyolefin such as a polyethylene, a polypropylene, a polybutylene or an ethylene-propylene copolymer, a polyisobutyrate, an ethylene-vinyl acetate copolymer, combinations thereof, and the like. In embodiments, the crystalline resin may be sulfonated.

The crystalline resin may be prepared by a polycondensation process of reacting an organic diol and an organic diacid in the presence of a polycondensation catalyst.

Examples of organic diols include aliphatic dials with from about 2 to about 8 carbon atoms, such as 1,2-ethanediol, 1,3-propanediol, 1,4-butanediol, 1,5-pentanediol, 1,6-hexanediol, 1,7-heptanediol, 1,8-octanediol, and the like; alkali sulfa-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfa-1,3-propanediol, mixtures thereof, and the like.

In embodiments, the aliphatic diol may be present in an amount of from about 45 to about 50 mole percent of the resin, in embodiments from about 47 to about 49 mole percent of the resin, and the alkali sulfo-aliphatic dial can be present in an amount of from about 1 to about 10 mole percent of the resin, in embodiments from about 2 to about 8 mole percent of the resin.

Examples of organic diacids or diesters suitable for the preparation of the crystalline resins include oxalic acid, succinic acid, glutaric acid, adipic acid, suberic acid, azelaic acid, phthalic acid, isophthalic acid, terephthalic acid, cyclohexane dicarboxylic acid, malonic acid and mesaconic acid; diesters or anhydrides thereof; and alkali sulfo-organic diacids such as the sodium, lithium or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfa-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or combinations thereof.

In embodiments, the organic diacid may be present in an amount of, for example, from about 40 to about 50 mole percent of the resin, in embodiments from about 42 to about 48 mole percent of the resin, and the alkali sulfo-aliphatic diacid can be present in an amount of from about 1 to about 10 mole percent of the resin, in embodiments from about 2 to about 8 mole percent of the resin.

In embodiments, the crystalline polyester material may be derived from a monomer system including an alcohol such as 1,4-butanediol, 1,6-hexanediol, and combinations thereof, with a dicarboxylic acid such as fumaric acid, succinic acid, oxalic acid, adipic acid, and combinations thereof. For example, in embodiments the crystalline polyester may be derived from 1,4-butanediol, adipic acid, and fumaric acid.

In embodiments, a stoichiometric equimolar ratio of organic diol and organic diacid may be utilized. However, in some instances, wherein the boiling point of the organic diol is from about 180° C. to about 230° C., an excess amount of diol can be utilized and removed during the polycondensation process.

Suitable polycondensation catalysts for production of either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or combinations thereof.

In embodiments, catalysts may be utilized in amounts of, for example, from about 0.01 mole percent to about 5 mole percent based on the starting diacid or diester used to generate the polyester resin, in embodiments from about 0.5 to about 4 mole percent of the resin based on the starting diacid or diester used to generate the polyester resin. The amount of catalyst utilized may vary, and can be selected in an amount, for example, of from about 0.01 to about 1 mole percent of the resin. Additionally, in place of an organic diacid, an organic diester can also be selected, with an alcohol byproduct generated during the process.

Suitable crystalline resins include, in embodiments, poly (ethylene-adipate), polypropylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 70° C. to about 150° C. in embodiments from about 80° C. to about 140° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by GPC using polystyrene standards. The molecular weight distribution (Mw/Mn) of the crystalline resin may be, for example, from about 1 to about 6, in embodiments from about 2 to about 4.

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 4% (first resin)/96% (second resin) to about 96% (first resin)/4% (second resin). Where the resin includes an amorphous resin, a crystalline resin, and a bio-based amorphous resin, the weight ratio of the three resins may be from about 97% (amorphous resin): 2% (crystalline resin): 1% (bio-based amorphous resin), to about 92% (amorphous resin): 4% (crystalline resin): 4% (bio-based amorphous resin).

Toner

The resin described above may be utilized to form toner compositions. Such toner compositions may include colorants, waxes, and additives.

Colorants

As the colorant to be added, various known suitable colorants, such as dyes, pigments, mixtures of dyes, mixtures of pigments, mixtures of dyes and pigments, and the like, may be included in the toner.

As examples of suitable colorants, mention may be made of carbon black like REGAL 330; magnetites, such as Mobay magnetites M08029, M08060; Columbian magnetites; MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CT 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan H (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and colorant in forming the toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 200 to about 20,000, in embodiments from about 400 to about 5,000.

Waxes that may be used include, for example, polyolefins such as polyethylene, polypropylene, and polybutene waxes such as commercially available from Allied Chemical and Petrolite Corporation, for example POLYWAX polyethylene waxes from Baker Petrolite, wax emulsions available from Michaelman, Inc. and the Daniels Products Company, EPOLENE N-15 commercially available from Eastman Chemical Products, Inc., and VISCOL 550-P, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550, SUPERSLIP 6530 available from Micro Powder Inc., fluorinated waxes, for example POLYFLUO 190, POLYFLUO 200, POLYSILK 19, POLYSILK 14 available from Micro Powder Inc., mixed fluorinated, amide waxes, for example MICROSPERSION 19 also available from Micro Powder Inc., imides, esters, quaternary amines, carboxylic acids or acrylic polymer emulsion, for example JONCRYL 74, 89, 130, 537, and 538, all available from SC Johnson Wax, and chlorinated polypropylenes and polyethylenes available from Allied Chemical and Petrolite Corporation and SC Johnson Wax. Mixtures and combinations of the foregoing waxes may also be used in embodiments. Waxes may be included as, for example, fuser roll release agents.

Additives

In embodiments, the toner particles may also contain additives, as desired or required. For example, the toner may include any known charge additives in amounts of from about 0.1 to about 10 weight percent, and in embodiments of from about 0.5 to 7 weight percent of the toner. Examples of such charge additives include alkyl pyridinium halides, bisulfates, the charge control additives of U.S. Pat. Nos. 3,944,493, 4,007,293, 4,079,014, 4,394,430, and 4,560,635, the disclosures of each of which are hereby incorporated by reference in their entirety, negative charge enhancing additives like aluminum complexes, and the like.

In addition, there can be blended with the toner particles in the high-speed blender external surface additive particles including flow aid additives, which additives may be present on the surface of the toner particles. In embodiments, surface additives may be present in an amount of from 0.1-5% by weight, or from about 0.3-3% by weight. The surface additive particles may be from 7 nm to 300 nm in size, in embodiments from 7 nm to 200 nm.

Examples of these surface additives include metal oxides, such as titanium oxide, silicon oxide, tin oxide, mixtures thereof, and the like; colloidal and amorphous silicas, such as AEROSIL, metal salts and metal salts of fatty acids inclusive of zinc stearate, aluminum oxides, cerium oxides, and mixtures thereof.

Suitable additives include those disclosed in U.S. Pat. Nos. 3,590,000, 6,214,507, and 7,452,646 the disclosures of each of which are hereby incorporated by reference in their entirety.

Toner Preparation

The toner particles may be formed according to the conventional process, which generally includes (1) extrusion, (2) grinding, (3) classification, and (4) blending.

Extrusion

The conventional process for forming dry toner particles generally begins by melt-mixing a heated polymer resin with a colorant in an extruder, such as a Werner Pfleiderer ZSK-53 or WP-28 extruder, so that the colorant is dispersed in the polymer. For example, the Werner Pfleiderer Wp-28 extruder, equipped with a 15 horsepower motor, is well-suited for melt-blending of the resin, colorant, and any other additives.

The toner colorants may be particulate pigments or, alternatively, dyes, as previously described above. Numerous colorants can be used in this process. A suitable toner resin is then mixed with the colorant by the downstream injection of the colorant dispersion.

In embodiments, toners may be formed by melt-mixing utilizing methods and apparatus within the purview of those skilled in the art. For example, melt-mixing of the toner ingredients can be accomplished by physically mixing or blending the particles of the above components and then melt-mixing. Suitable temperatures may be applied to the extruder or similar apparatus, for example from about 65° C. to about 200° C., in embodiments from about 80° C. to about 120° C.

The resin or resins are generally present in the resin-toner mixture in an amount from about 50 weight percent to about 99 weight percent of the toner composition, in embodiments from about 70 weight percent to about 97 weight percent of the toner composition, with the colorant being present in an amount from about 1 to about 50 weight percent of the toner composition, in embodiments from about 3 to about 20 weight percent of the toner composition.

Additional "internal" components of the toner may be added to the resin prior to mixing the toner with the additive. Alternatively, these components may be added during extrusion. Various known suitable effective charge control additives can be incorporated into toner compositions, such as quaternary ammonium compounds and alkyl pyridinium compounds, including cetyl pyridinium halides and cetyl pyridinium tetrafluoroborates, as disclosed in U.S. Pat. No. 4,298,672, the disclosure of which is totally incorporated herein by reference, distearyl dimethyl ammonium methyl sulfate, and the like. The internal charge enhancing additives are usually present in the final toner composition in an amount of from about 0 percent by weight to about 20 percent by weight.

Grinding

After the resin, colorants, optional wax, and any internal additives have been extruded, the resin mixture is reduced in size by any suitable method, including those known in the art. Such reduction is aided by the brittleness of most toners that causes the resin to fracture when impacted. This allows rapid particle size reduction in pulverizers or attritors, such as media mills, jet mills, hammer mills, or similar devices. An example of a suitable jet mill is an Alpine 800 AFG Fluidized Bed Opposed Jet Mill. Such a jet mill is capable of reducing typical toner particles to a size of about 4 microns to about 30 microns. For color toners, toner particle sizes may average within an even smaller range of 4-10 microns.

In embodiments, the grinding achieves toner particles with a volume median diameter of less than about 25 microns, in other embodiments form about 5 microns to about 15 microns, and in still other embodiments from about 5.5 microns to about 12 microns, which diameters can be determined by a Multisizer II from Beckman Coulter.

Classification

Inside the jet mill, a classification process sorts the particles according to size. Particles classified as too large are rejected by a classifier wheel and conveyed by air to the grinding zone inside the jet mill for further reduction. Particles within the accepted range are passed onto the next toner manufacturing process.

After reduction of particle size by grinding or pulverizing, a classification process sorts the particles according to size. Particles classified as too fine are removed from the product eligible particles. The fine particles have a significant impact on print quality and the concentration of these particles varies between products. The product eligible particles are collected separately and passed to the next toner manufacturing process.

In embodiments, the toner compositions can be classified utilizing, for example, a Donaldson Model B classifier to remove toner fine particles, that is, toner particles less than about 5 microns in volume median diameter, or less than about 4 microns in volume median diameter.

Blending

After classification the next typical process is a high speed blending process wherein surface additive particles are mixed with the classified toner particles within a high speed blender. These additives include but are not limited to additive particles including flow aid additives, which additives may be present on the surface of the toner particles. Examples of these surface additives include metal oxides, such as titanium oxide, silicon oxide, tin oxide, mixtures thereof, and the like; colloidal and amorphous silicas, such as AEROSIL, metal salts and metal salts of fatty acids inclusive of zinc stearate, aluminum oxides, cerium oxides, and mixtures thereof.

Suitable additives include those disclosed in U.S. Pat. Nos. 3,590,000, 6,214,507, and 7,452,646 the disclosures of each of which are hereby incorporated by reference in their entirety.

The amount of additives may be measured in terms of percentage by weight of the toner composition, and the additives themselves are not included when calculating the percentage composition of the toner. For example, a toner composition containing a resin, a colorant, and an external additive may comprise 80 percent by weight resin and 20 percent by weight colorant. The amount of external additive present is reported in terms of its percent by weight of the combined resin and colorant. The combination of smaller toner particle sizes required by some newer color toners and the increased size and coverage of additive particles for such color toners increases the need for high intensity blending.

In embodiments, the surface additives may be present in an amount of from 0 to about 20 weight percent of the toner mixture, in embodiments of from 0.1 to 10 weight percent of the mixture, or from about 0.1 to 5 weight percent, or from 0.3 to 3 weight percent, or from 0.5 to 1.5 weight percent of the mixture. In further embodiments, the toner mixture may include, for example, from about 0.1 weight percent to about 5 weight percent titania, from about 0.1 weight percent to about 8 weight percent silica, and from about 0.1 weight percent to about 4 weight percent zinc stearate. The surface additive particles may be from 7 nm to 300 nm in size, in embodiments from 7 nm to 200 nm.

The above additives may be added to the pulverized toner particles in a high speed blender such as a Henschel Blender FM-10, 75 or 600 blender. The high intensity blending serves to break additive agglomerates into the appropriate nanometer size, evenly distribute the smallest possible additive particles within the toner batch, and attach the smaller additive particles to toner particles. Each of these processes occurs concurrently within the blender. Additive particles become attached to the surface of the pulverized toner particles during collisions between particles and between particles and the blending tool as it rotates. It is believed that such attachment between toner particles and surface additives occurs due to both mechanical impaction and electrostatic attractions. The amount of such attachments is proportional to the intensity level of blending which, in turn, is a function of both the speed and shape of the blending tool. The surface additives may form a coating on the toner particles. Depending on the size of the surface additive particles, the surface layer thickness of the coating layer may be from 7 nm to 300 nm, in embodiments from 7 nm to 200 nm.

The amount of time used for the blending process plus the intensity determines how much energy is applied during the blending process. For an efficient blending tool that avoids snow plowing and excessive vortices and low density regions, "intensity" can be effectively measured by reference to the power consumed by the blending motor per unit mass of blended toner (typically expressed as Watts/lb). Using a standard Henschel Blender tool to manufacture conventional toners, the blending times typically range from one (1) minute to twenty (20) minutes per typical batch of 1-500 kilograms. For certain more recent toners such as toners for Xerox Docucenter 265 and related multifunctional printers, blending speed and times are increased in order to assure that multiple layers of surface additives become attached to the toner particles. Additionally, for those toners that require a greater proportion of additive particles in excess of 25 nm, more blending speed and time is required to force the larger additives into the base resin particles.

The above described process for making electrophotographic toners is well known in the art. More information concerning methods and apparatus for manufacture of toner are available in the following U.S. patents, each of the disclosures of which are incorporated herein: U.S. Pat. No.

4,338,380 issued to Erickson et al.; U.S. Pat. No. 4,298,672 issued to Chin; U.S. Pat. No. 3,944,493 issued to Jadwin; U.S. Pat. No. 4,007,293 issued to Mincer et al.; U.S. Pat. No. 4,054,465 issued to Ziobrowski; U.S. Pat. No. 4,079,014 issued to Burness et al.; U.S. Pat. No. 4,394,430 issued to Jadwin et al.; U.S. Pat. No. 4,433,040 issued to Niimura et al.; U.S. Pat. No. 4,845,003 issued to Kiriu et al.; U.S. Pat. No. 4,894,308 issued to Mahabadi et al.; U.S. Pat. No. 4,937,157 issued to Haack et al.; U.S. Pat. No. 4,937,439 issued to Chang et al.; U.S. Pat. No. 5,370,962 issued to Anderson et al.; U.S. Pat. No. 5,624,079 issued to Higuchi et al.; U.S. Pat. No. 5,716,751 issued to Bertrand et al.; U.S. Pat. No. 5,763,132 issued to Ott et al.; U.S. Pat. No. 5,874,034 issued to Proper et al.; and U.S. Pat. No. 5,998,079 issued to Tompson et al.

Alternatively, in embodiments, the initial distribution of the surface additives may be accomplished only through the surface processing step discussed in more detail below, rather than through the high speed blending process. In such embodiments, the high speed blending step in producing the dry toner particles may be eliminated.

Surface Processing

In embodiments, after the toner particles are produced according to the conventional method, they are then subjected to surface processing. In embodiments, the toner particles produced according to the conventional method generally have a circularity of from about 0.85 to about 0.95. The volume average diameter or "volume average particle diameter" of the toner particles is generally from about 3 to about 25 microns, in embodiments from about 5 to about 12 microns, or even 8 to 9 microns.

The processing comprises processing the toner particles in a conical mixer that heats and stirs the material. Such a conical mixer is, for example, sold under the trademark CYCLOMIX (available from Hosokawa Micron). The conical mixer has a heating and cooling jacket to facilitate heating and/or cooling of material. The conical mixer also includes co-axial mixing tools that are configured to wipe the internal surfaces of the conical mixer to promote surface modification without agglomeration. This configuration is not present in other mixers, such as the high speed blender employed in the mixing step in forming the toner particles discussed above.

In embodiments, the toner particles produced by a conventional process may be processed with additional surface additives. If enough surface additives are already present on the toner particles, then it may not be necessary to add additional surface additives during the surface processing of the toner particles in a conical mixer. Enough surface additives need to present to enable surface processing of the individual particles without multi-particle agglomeration. Alternatively, in embodiments, the toner particles produced by a conventional process may not undergo the high speed blending process with surface additives prior to surface processing. In such embodiments, the initial distribution of surface additives occurs during the surface processing in the conical mixer.

The surface additives, or additional surface additives, that may be processed with the toner particles may be of the same type as the surface additives that may be added during high speed blending. Examples of the surface additives that may be processed with the toner particles include, for example, metal oxides such as titanium oxide, silicon oxide, tin oxide, mixtures thereof, and the like; colloidal and amorphous silicas, such as AEROSIL, metal salts and metal salts of fatty acids inclusive of zinc stearate, calcium stearate, aluminum oxides, cerium oxides, and mixtures thereof; and long chain alcohols such as UNILIN 700, and combinations thereof.

In general, silica may be applied for toner flow, enhancement of triboelectric charge, admix control, improved development and transfer stability, and higher toner blocking temperature. $TiO_2$ may be applied for improved relative humidity (RH) stability, control of triboelectric charge, and improved development and transfer stability. Zinc stearate, calcium stearate, and/or magnesium stearate may optionally also be used as an external additive for providing lubricating properties, developer conductivity, enhancement of triboelectric charge, enabling higher toner charge and charge stability. In embodiments, a commercially available zinc state known as Zinc Stearate L, obtained from Ferro Corporation, may be used.

Each of these additives may be present in an amount of from 0.1-5% by weight of the toner, in embodiments of from about 0.3-3% by weight, such as from 0.5-1.5% by weight. The surface additive particles may be from 7 nm to 300 nm in size, in embodiments from 7 nm to 200 nm.

In embodiments, the mixture of dry toner particles produced by the conventional method may be combined with one or more of the additional surface additives and placed within the conical mixer. The temperature of the conical mixer vessel may be controlled such that the toner resins are not exposed to a corresponding glass transition temperature or Tg, which could lead to some undesirable adhesion between the resins prior to mixing and/or coating with the additives. Accordingly, the heating/cooling jacket of the conical mixer vessel may be initially set to a temperature of less than or equal to the Tg of the resins in the toner. In embodiments, the heating/cooling jacket of the conical mixer vessel is set to achieve an internal temperature in the mixer vessel of about 15° C.-30° C., preferably from about 20° C.-25° C.

The conical mixer with a temperature control may then be operated such that the rotor of the mixer may preferably be configured to mix in a multiple stage sequence, wherein each stage may be defined by a selected rotor rpm value and a selected time period. In embodiments, the rotor may be initially operated to disperse the additional additives. For example, the rotor may be initially operated to mix at a value of 800 rpm-1600 rpm, in embodiments from about 1100 rpm-1400 rpm, in further embodiments from about 1200 rpm-1300 rpm. Furthermore, the first stage mixing may be controlled in time, such that the conical mixer operates at such rpm values for a period of 30 seconds-120 seconds, in embodiments for a period of 45 seconds-75 seconds.

Then, in a second stage of mixing, the rpm value may be set lower than the rpm value of the first stage, e.g., at an rpm value of 300-700 rpm, or even 400-600 rpm. Furthermore, this second stage of mixing may be controlled in temperature, such that the temperature of the heating/cooling jacket of the vessel increases to about 50-100° C., in embodiments about 60-80° C., or about 70° C. This second stage is also controlled in time, such that the mixture is processed in the conical mixer at these setpoints for about 30 minutes-about 120 minutes, in embodiments for 45 minutes-75 minutes, to enable the dispersed additives to form a continuous film and fuse to the toner particles.

Because the scale or diameter of the conical mixer varies such that the conical mixer is wider at the top than at the bottom portion, the tool stack in the conical mixer that mixes the contents also contains a range of tool diameters (i.e., larger diameters at the top, lower diameters at the bottom). Thus, varied tip speeds of the blending tools inside the conical mixer are present at the rpm settings described above for embodiments. At the first stage of mixing, the tip speed for a tool diameter of about 140 mm may be from about 5.9 m/sec to about 10.7 m/sec, in embodiments from about 8.1 m/sec to about 10.3 msec, in further embodiments from about 8.8 m/sec to about 9.5 m/see, whereas the tip speed for a tool diameter of about 280 mm may be from about 11.7 msec to about 23.6 m/sec, in embodiments from about 16.1 m/sec to about 20.5 m/sec, in further embodiments from about 17.6 msec to about 19.1 m/sec. At the second stage of mixing, the tip speed for a tool diameter of about 140 mm may be from about 2.2 m/sec to about 5.1 m/sec, in embodiments from about 2.9 m/sec to about 4.4 m/sec, whereas the tip speed for a tool diameter of about 280 mm may be from about 4.4 msec to about 10.3 m/sec, in embodiments from about 5.9 msec to about 8.8 m/sec.

Thereafter, in a third stage, the mixture is further cooled by lowering the temperature of the heating/cooling jacket to preferably 25° C. or less. After the cooling stage, the coated toner particles are discharged.

Dry Toner Particles with Durable Surface Additive Layer

The dry toner particles produced according to embodiments have particle characteristics, especially shape, similar to chemically made toners. The dry toners produced according to embodiments additionally have a durable surface additive layer.

The thickness of the surface additive layer on the resulting dry toner particles is from about 7 nm to about 300 nm, in embodiments from 7 nm to 200 n nm, or 50 nm to 200 nm, or 100 nm to 200 nm. As viewed by TEM, the surface additive "shell" may appear to be 1-5 surface additive layers, in embodiments 3 to 5 surface additive layers. The resulting toner particles, after surface processing in the conical mixer according to embodiments, may possess a circularity of from about 0.951 to about 0.99, in embodiments from about 0.96 to 0.98. Circularity may be determined with a Sysmex FPIA-300 Particle Characterization System from Malvern Instruments Ltd. (Worcestershire, UK). Thus, the circularity of the dry toner particles is similar to the circularity of toner particles obtained by chemical emulsion/aggregation, and greater than the circularity of dry toner particles obtained by the conventional method of producing dry toner particles without surface processing.

Further characteristics of the toner particles may be determined by any suitable technique and apparatus. For example, volume average particle diameter ($D_{50v}$), number average geometric size distribution (GSDn) and/or volume average geometric size distribution (GSDv) may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

In embodiments, the resulting particles can possess an average volume particle diameter of from about 5 microns to about 15 microns, in embodiments from about 7 microns to about 9 microns; and a GSDn and/or GSDv of from about 1.1 to 1.5. In embodiments, the resulting particles can possess a GSDn of 1.0 to 1.3, or 1.1 to 1.28. In embodiments, the resulting particles can possess a GSDv of 1.0-1.2, or 1.1 to 1.75.

The following Examples are being submitted to illustrate embodiments of the present disclosure. These Examples are intended to be illustrative only and are not intended to limit the scope of the disclosure.

EXAMPLES

Figure 2:
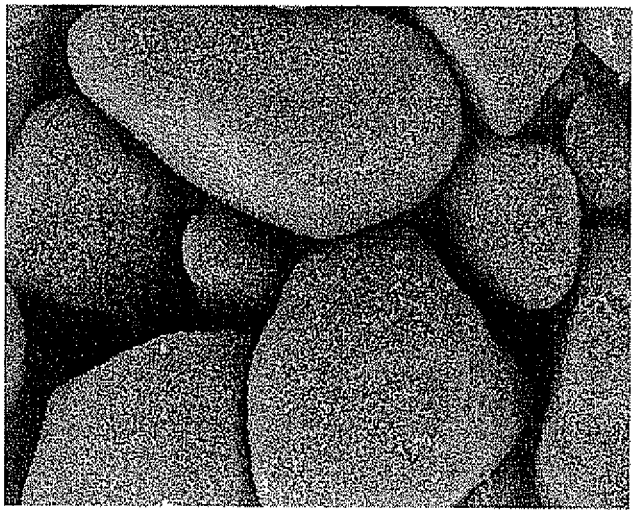
FIG. 2 is a SEM image of toner particles according to an embodiment after surface processing.

For illustration purposes only, FIG. 1 depicts a SEM image of toner particles before surface processing, and FIG. 2 depicts a SEM image of toner particles after surface processing. The Figures show that, after surface processing, the surface irregularities of the toner particles have been smoothed, and the surface additives are evenly coated and more embedded.

Figure 3:
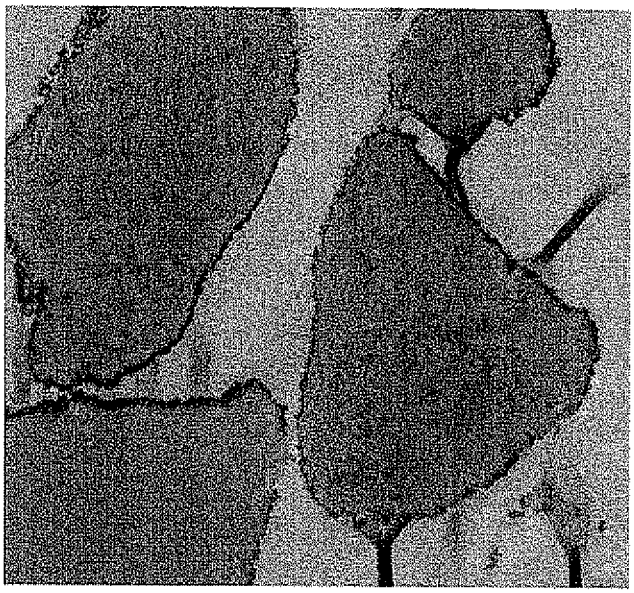
FIG. 3 is a Transmission Electro-Micrograph (TEM) image of a slice through a toner particle according to an embodiment before surface processing.
Figure 4:
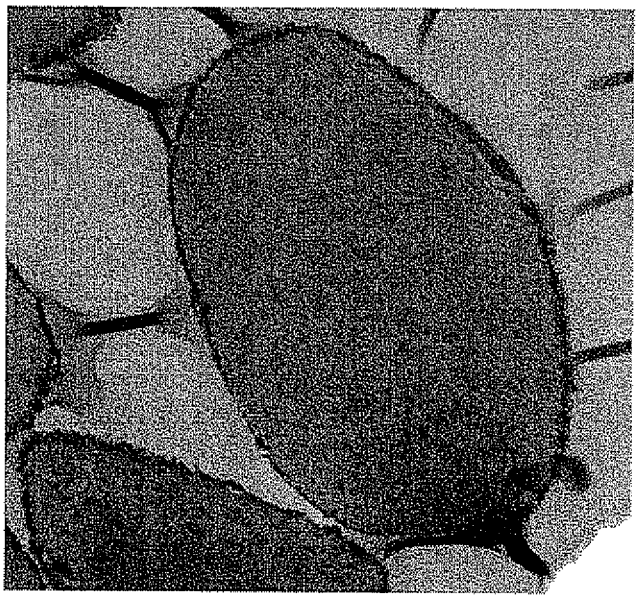
FIG. 4 is a TEM image of a slice through a toner particle according to an embodiment after surface processing.

For illustration purposes only, FIG. 3 depicts a TEM image of a slice through a dry toner particle before surface processing, and FIG. 4 depicts a TEM image of a dry toner particle after surface processing. The TEM images of FIGS. 3 and 4 show that the surface processing results in higher particle circularity without significantly impacting the distribution of the internal constituents.

Example 1

A Xerox iGen3™ dry ink toner consisting of a mixture of linear and cross-linked polyester resins, along with pigment, was produced according to a conventional process of forming dry toner particles, and blended with surface additives.

The toner particles were then further processed in a 5 L CYCLOMIX (Hosokawa Micron) conical mixer with 1% additional surface additive particles. The CYCLOMIX was run for 1 minute at 1300 rpm to disperse the additional additive. Thereafter, the CYCLOMIX jacket temperature was increased to 69° C., and the mixing speed was slowed to 600 rpm to process the toner particles and the additive particles at these setpoints for 60 minutes. The material was then cooled in the CYCLOMIX by lowering the jacket temperature prior to discharging the material.

Tables 1-3 below set forth the data obtained for the toner produced according to the Example above. The surface processing of conventionally extruded/kneaded dry toner particles is further evident in comparing TEM and SEM data, since these materials have an exterior that resembles an exterior of chemically produced toner particles, while the internal constituents of the toner particles retain the dispersion characteristics of the extrusion/kneading process.

TABLE 1

| Description | Volume Median (micron) | % Fines 1.4-4.00 (micron) | Number Ratio 50/16 | Volume Ratio 84/50 | Circularity (Sysmex 3000) |
|---|---|---|---|---|---|
| Before Surface Processing | 8.36 | 7.94 | 1.346 | 1.185 | 0.951 |
| After Surface Processing | 8.35 | 3.92 | 1.272 | 1.174 | 0.968 |
| Chemical Toner 1 | 7.46 | 3.00 | 1.222 | 1.224 | 0.982 |
| Chemical Toner 2 | 5.58 | 13.38 | 1.229 | 1.185 | 0.976 |

The above Table 1 provides a comparison of chemically produced toners with conventionally produced toner particles before and after surface processing according to embodiments.

The circularity is a ratio of the projected diameter to that of a sphere, with 1.0 meaning completely spherical. A circularity of 0.968 on the Sysmex 3000 is equivalent to the circularity of many chemically produced toners. The number ratio 50/16, also referred to as GSDn above, is the number average geometric size distribution, which is an indicator of the sharpness of the size distribution below the median, with 1.0 being the lowest value (i.e., no distribution below the median). The number ratio 50/16 of 1.27 is equivalent to that of many chemically produced toner particles.

TABLE 2

| Particle Size Comparison | | | | | | | | | |
|---|---|---|---|---|---|---|---|---|---|
| | | | % SiO2 | Volume | | Number Ratio | Volume Ratio | Circularity | |
| Descriptions | Time | HJT | Added | Median | % Fines | 50/16 | 84/50 | SYS3000 | SYS2100 |
| Before Surface Processing | | | | 8.36 | 7.94 | 1.346 | 1.185 | 0.951 | 0.928 |
| After Surface Processing | 60 | 69 | 1 | 8.35 | 3.92 | 1.272 | 1.174 | 0.968 | 0.950 |

Table 2 shows a quantitative particle size comparison before and after surface processing. The toner particles "before surface processing" are finished Xerox iGen3™ Cyan toner particles. The toner particles "after surface processing" are toner particles that were further processed with 1% additional silica surface additives. After surface processing, the fines material is reduced, and the number ratio 50/16 is also reduced. The number ratio 50/16 of 1.27 is equivalent to that of many chemically produced toner particles.

The circularity is a ratio of the projected diameter to that of a sphere, with 1.0 meaning completely spherical. A circularity of 0.968 on the Sysmex 3000 is equivalent to the circularity of many chemically produced toners. Although a higher circularity is indicative of increased transfer efficiency, a highly circular particle has been found to be difficult to clean in blade-cleaning systems. Thus, a trade-off has been found to be the optimum compromise.

TABLE 3

| Additive attachment and charging comparison | | | | | | | | | | | | | | | |
|---|---|---|---|---|---|---|---|---|---|---|---|---|---|---|---|
| | | | | | | | | | | ADMIX | | | | | |
| | | | % SiO2 | | | AAFD | | | % SiO2 | Initial | | | 60 Seconds | | |
| Descriptions | Time | HJT | Added | Tribo | TC | 3K | 6K | 12K | Additive | Q/D | % CLC | % CWS | Q/D | % CLC | % CWS |
| Before Surface Processing | | | | 32.1 | 4.1 | 100 | 76 | | 5.0 | −0.9 | 0.97 | 0.81 | −0.65 | 3.08 | 2.42 |
| After Surface Processing | 60 | 69 | 1 | 23.5 | 4.2 | 98 | 97 | 96 | 4.1 | −0.73 | 3.67 | 2.31 | −0.44 | 3.56 | 2.63 |

Table 3 shows a comparison of the surface attachment of additives and charging before and after surface processing. The toner particles "before surface processing" are finished Xerox iGen3™ Cyan toner particles. The toner particles "after surface processing" are toner particles that were further processed with 1% additional silica surface additives. The additive attachment of the surface processed toner is indicated by AAFD metrics, performed at 3K-12K Joules of sonification. The surface processed toner particles have a strongly attached shell of additives.

For charging, the Tribo of the surface processed material was lower than before surface processing. The charge-spectrographs (ADMIX) also show lower mean values (Q/D). Through 60 seconds of mixing after adding 2% additional toner, the low charge and wrong-sign material were equivalent to the control. The charge can be improved by further variation of the additive package to optimize for effects of the surface processing.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for producing toner particles, comprising:

forming dry toner particles comprising a toner resin, a colorant, an optional wax, and surface additives, wherein the dry toner particles have a circularity and a particle size distribution; and then processing the toner particles in a conical mixer, comprising:

mixing the toner particles at a first rotational speed for a first period of time to disperse additional additives on the toner particles;

mixing the toner particles at a second rotational speed for a second period of time to enable the dispersed additives to form a continuous film and fuse to the toner particles, wherein the first rotational speed is greater than the second rotational speed and the first period of time is less than the second period of time; and coating the toner particles with an additive shell comprising 1-5 continuous layers of additives, wherein the processed toner particles have an increased circularity and a narrower particle size distribution than the toner particles prior to processing.

2. The method according to claim 1, wherein the forming of the dry toner particles comprises:

melt-mixing the toner resin with the colorant and, optionally, the wax in an extruder to form a toner mixture;

grinding the extruded mixture;

classifying the ground particles into particles averaging 4 to 10 microns in size; and blending the classified toner particles with surface additives in a high-speed blender to form the dry toner particles.

3. The method according to claim 1, wherein the processed toner particles have a circularity of from 0.951 to 0.99.

4. The method according to claim 1, wherein the processed toner particles have a number average geometric size distribution (GSDn) of 1.0 to 1.3.

5. The method according to claim 1, wherein the processed toner particles have a volume average geometric size distribution (GSDv) of 1.0 to 1.2.

6. The method according to claim 1, wherein the processed toner particles have a number average geometric size distribution (GSDn) of 1.1 to 1.28, and a volume average geometric size distribution (GSDv) of 1.1 to 1.175.

7. The method according to claim 1, wherein the processed toner particles have an average volume particle diameter of from 7-9 microns.

8. The method according to claim 1, wherein the surface additive particles are from 7 nm to 300 nm in size.

9. The method according to claim 1, wherein the processed toner particles have a surface layer of the surface additives, the surface layer having a thickness of 7 nm to 300 nm.

10. The method according to claim 1, wherein the processing of the toner particles in the presence of additional surface additives, the additional surface additives being added to the conical mixer in an amount of 0.1 to 5 wt % of the toner particles.

11. The method according to claim 10, wherein the additional additives are at least one selected from the group consisting of titanium oxide, silicon oxide, tin oxide, cerium oxide, zinc stearate, calcium stearate, colloidal silicas, and amorphous silicas.

12. The method according to claim 1, wherein the conical mixer comprises a vessel surrounded by a heating/cooling jacket, the vessel comprising co-axial mixing tools that are configured to wipe an internal surface of the vessel.

13. The method according to claim 1, wherein:

the first rotational speed corresponds to a tip speed of about 8.1 m/sec to about 10.3 msec for a mixing tool diameter of about 140 mm, and a tip speed of 16.1 m/sec to about 20.5 m/sec for a mixing tool diameter of about 280 mm, and the first period of time is in a range of 30 seconds to 120 seconds; and the second rotational speed corresponds to a tip speed of about 2.2 m/sec to about 5.1 msec for a mixing tool diameter of about 140 mm, and a tip speed of 4.4 msec to about 10.3 m/sec for a mixing tool diameter of 280 mm, and the second period of time is in a range of 30 minutes to 120 minutes.

14. A method for producing toner particles, comprising:

forming dry toner particles comprising a toner resin, a colorant, an optional wax, and surface additives, wherein the dry toner particles have a circularity and a particle size distribution; and then processing the toner particles in a conical mixer, comprising:

mixing the toner particles at a first rotational speed for a first period of time to disperse additional additives on the toner particles:

mixing the tone articles at a second rotational seed for a second period of time to enable the dispersed additives to form a continuous film and fuse to the toner particles, wherein the first rotational speed is greater than the second rotational speed, the first period of time is less than the second period of time, and mixing the toner particles at the first rotational speed for the first period of time at a temperature of 15 to 30° C., and mixing the toner particles at a second rotational speed for the second period of time at a temperature of 50 to 100° C.; and coating the toner articles with an additive shell comprising 1-5 continuous layers of additives, wherein the processed toner particles have an increased circularity and a narrower particle size distribution than the toner particles prior top processing.

15. The method according to claim 14, wherein the first rotational speed corresponds to a tip speed of about 8.1 m/sec to about 10.3 m/sec for a mixing tool diameter of about 140 mm, and a tip speed of 16.1 m/sec to about 20.5 m/sec for a mixing tool diameter of about 280 mm, and the first period of time is in a range of 30 seconds to 120 seconds; and the second rotational speed corresponds to a tip speed of about 2.2 msec to about 5.1 msec for a mixing tool diameter of about 140 mm, and a tip speed of 4.4 m/sec to about 10.3 msec for a mixing tool diameter of 280 mm, and the second period of time is in a range of 30 minutes to 120 minutes.

16. A method for producing toner particles, comprising:

forming dry toner particles comprising a toner resin, a colorant, and an optional wax, wherein the dry toner particles have a circularity and a particle size distribution; and then processing the toner particles in a conical mixer with surface additives, the surface additives being present in an amount of 0.1 to 5 wt. % of the toner particles, comprising:

mixing the toner particles at a first rotational speed for a first period of time to disperse the surface additives on the toner particles;

mixing the toner particles at a second rotational speed for a second period of time to enable the surface additives to form a continuous film and fuse to the toner particles, wherein the first rotational speed is greater than the second rotational speed, and the first period of time is less than the second period of time; and coating the tone particles with a surface additive shell comprising 1-5 continuous layers of surface additives, wherein the processed toner particles have an increased circularity and a narrower particle size distribution than the toner particles prior to processing.

17. The method according to claim 16, wherein the processed toner particles have a number average geometric size distribution (GSDn) of 1.1 to 1.28, and a volume average geometric size distribution (GSDv) of 1.1 to 1.175.

18. The method according to claim 16, wherein the processed toner particles have an average volume particle diameter of from 7-9 microns.

19. The method according to claim 16, wherein the surface additive particles are from 7 nm to 300 nm in size.

20. The method according to claim 16, wherein the processed toner particles have a circularity of from 0.951 to 0.99.

* * * * *